US007552733B1

(12) United States Patent
Schubert, III

(10) Patent No.: US 7,552,733 B1
(45) Date of Patent: Jun. 30, 2009

(54) ADJUSTABLE BODY TREATMENT SUPPORT STRUCTURE

(76) Inventor: Kenneth L. Schubert, III, 1901—26th Ave. E., Seattle, WA (US) 98112

( * ) Notice: Subject to any disclaimer, the term of this patent is extended or adjusted under 35 U.S.C. 154(b) by 277 days.

(21) Appl. No.: 11/345,001

(22) Filed: Feb. 1, 2006

(51) Int. Cl.
*A61G 15/00* (2006.01)
*A47B 71/00* (2006.01)
*A47B 7/02* (2006.01)
*B68G 5/00* (2006.01)

(52) U.S. Cl. ..... 128/845; 5/652; 5/657; 5/600; 5/613; 5/617; 5/607; 5/608; 5/618; 5/619

(58) Field of Classification Search ..... 128/845, 128/846, 870; 5/638, 640, 622, 630, 632, 5/652, 657, 600, 613, 607, 608, 617, 618, 5/619; 108/65, 67, 115; 403/3, 4, 84, 85, 403/86, 103, 294, 295, 364; 52/64, 70, 71
See application file for complete search history.

(56) References Cited

U.S. PATENT DOCUMENTS 4,280,490 A * 7/1981 Santy ..... 602/16
5,829,080 A * 11/1998 Robillard et al. ..... 5/638
5,865,505 A * 2/1999 Eley ..... 297/354.13
5,979,976 A * 11/1999 Ferencik ..... 297/16.1
6,648,416 B2 * 11/2003 O'Connor et al. ..... 297/397
7,017,211 B2 * 3/2006 Krywiczanin et al. ..... 5/622

* cited by examiner

*Primary Examiner*—Patricia Bianco
*Assistant Examiner*—Tarla Patel
(74) *Attorney, Agent, or Firm*—Ann W. Speckman; Speckman Law Group PLLC

(57) ABSTRACT

An adjustable treatment support comprises at least three generally planar rigid support members mountable to one another in different angular orientations to provide a support structure having a variety of configurations. Individual support members are mountable to one another to provide a support structure suitable for use with a bed to provide an extending head support for massage and other types of body work. Individual support members may also be configured to provide a support structure suitable for use with a subject in a seated position at a chair adjacent a table. The individual support members are collapsible or detachable for convenient storage and transport. Kits comprising a plurality of support members, a bag for storing and transporting them, instructional materials, music and other relaxation accessories are also provided.

19 Claims, 7 Drawing Sheets

ADJUSTABLE BODY TREATMENT SUPPORT STRUCTURE

TECHNICAL FIELD OF THE INVENTION

The present invention relates to an adjustable massage and body treatment support structure comprising a plurality of support members that may be assembled in different configurations to support a subject in a sitting and a prone position, and to kits comprising such body treatment support structures.

BACKGROUND OF THE INVENTION AND DESCRIPTION OF PRIOR ART

Massage therapy is practiced by professionals and used by non-professionals in their homes in an effort to alleviate muscular discomfort and stress and to promote relaxation. As the number of people suffering from stress and recreational injuries increases so, too, does the demand for treatment of those afflictions and the use of relaxation techniques.

Massage techniques, as well as other types of body treatment techniques, are generally performed while a subject is lying prone on an elevated table or support. Tables conventionally used for professional treatment are heavy and well-braced and are not portable in any meaningful sense. Portable, folding treatment tables have been developed and numerous designs are in use. They are advantageous for many purposes because they can be collapsed and transported to various locations where they may be reassembled to provide a stable support structure, and they require less storage space. One of the disadvantages of folding treatment tables is that they are generally not as structurally stable as conventionally constructed tables. Nonetheless, the availability of collapsible, folding massage tables has allowed massage and other body treatment professionals to provide services at different locations, such as in clinics, medical and residential care facilities, in the workplace, and in homes. This has significantly improved access to massage treatment modalities.

For in-home and residential facility body treatment work, it would be convenient to use a bed as a treatment support surface for treating a subject while in the prone position. When the subject lies face down, exposing the shoulders and back for treatment, however, the subject's face contacts the bed, which is uncomfortable, impedes breathing, and produces misalignments of the neck and spine. Rotating the subject's head and resting the side of the subject's head on the bed surface is generally uncomfortable for a subject, particularly for extended periods of treatment time. U.S. Pat. No. 6,148,460 describes a massage and therapeutic bed extension device providing an extension for a bed that supports a subject's head more comfortably and maintains alignment of the spine and neck.

Sitting massage support structures have also been developed. Some are adjustable and have active massage elements and are intended to be occupied by a subject in a conventional seated position. Seated massage support structures having supports for a subject to lean into and a headrest to support a subject's head, thereby exposing the back and shoulders for treatment, are also available. Some of these have adjustable features, allowing a therapist to modify the structure to accommodate subjects of different sizes.

Many portable massage support structures are suitable for use by treatment professionals, but they are not well-suited to casual, in-home use as a consequence of their expense and bulk. The present invention is therefore directed to a body treatment support structure that is conveniently stored and transported, and that may be assembled in a variety of configurations to provide treatment of subjects in both prone and sitting positions.

SUMMARY OF THE INVENTION

The adjustable support structure of the present invention comprises at least three generally planar support members mountable to one another at different angular orientations to provide a support structure having a variety of configurations. The individual support members are mountable to one another to provide a support structure suitable for use with a bed or a similar structure to provide head support extension for massage or other types of body work. The individual support members may also be configured to provide a support structure suitable for use with a subject in a seated position in a chair.

The support members are substantially rigid and, in a preferred embodiment, are generally rectangular. The component support members may have substantially the same widths and thicknesses but preferably have different lengths. In one embodiment, the relative positions of the component support members when assembled are interchangeable to provide support structures having different dimensions and configurations. At least one of the support members may be provided with a generally circular or oval recess or cut-out for receiving and providing air circulation to the subject's face. A cushioned head support may be provided as a component of the support structure and may be integral with or detachably mountable to at least one of the support members.

The at least three support members are mountable to one another directly, or through intermediate mounting structures, in a manner such that the members are detachable from one another and/or collapsible and foldable with respect to one another to facilitate transport and storage. The support members may be provided as individual structures that are detachable from and attachable to one another. In this embodiment, the at least three support members are stackable to form a small, flat package for storage and transport and can be assembled, at a desired site, in a variety of configurations. In an alternative embodiment, support members may be provided joined to one another in a unitary structure in which the individual support members are hinged and pivotable relative to one another to collapse the support members for storage and to provide assembly of the support components in various configurations. In this embodiment, the support members are fixable in at least two orientations to provide a rigid body treatment support structure having at least two different configurations.

Component support members may be assembled in at least two configurations. In one configuration, for example, the support members are mountable to one another and fixable in a stationary condition at generally right angles to provide a structure having a base member extending in a first direction on a first plane, an upstanding member mounted at generally right angles to the base member, and a support member mounted at generally right angles to the upstanding member and extending on a plane parallel to the first plane in a direction opposite the first direction. In this orientation, the base member may be positioned on a generally flat support, such as between a mattress and springs, the upstanding member may be generally the same height as the mattress, and, when the base member is positioned between a mattress and springs, the support member projects beyond the mattress and provides support for a subject's head. The relative positions of the support members may be rearranged to provide a support structure having the same general configuration and having the same angular orientation of support members, but having different dimensions at each support member position. Thus, the support member having substantially the same length as the mattress thickness is assembled as the upstanding member and the other support members serve as the base and head support members.

In another configuration, the support members are mountable to one another to provide a structure suitable for seated massage or body work. In this configuration, a base member is mounted and fixed in a stationary condition at a generally right angle to an upstanding member and a support member is mounted and fixed in a stationary condition relative to the upstanding member at an internal angle of from about 90° to about 160°. The base member may be supported by a table or another structure and, when a subject is standing or seated in a chair, the support member provides an angled support for the subject's head. Again, depending on the environment, the relative positions of the support members may be rearranged to provide a support structure having the same general configuration with the same angular orientation of support members, but having different dimensions at each support member position. In this configuration, for example, any of the support members may be assembled as the upstanding member to vary the height of the angled head support with respect to the base.

The support members may be provided as a kit. Support members in addition to the three support members described may be provided in a kit to provide additional flexibility in the construction of a support structure. The kit may include a bag for storing and/or transporting the disassembled or collapsed structural members. The kit may also include cushioning components, such as a head rest, and instructional materials, such as text and drawings in the form of a book or on electronic media illustrating exemplary constructions of the support structure and massage or treatment operations that may be performed on a subject in different positions. The kit may additionally, or alternatively, include music, candles, oils, emollients and other accessories that facilitate body treatment and promote relaxation.

BRIEF DESCRIPTION OF THE DRAWINGS

Various aspects of applicant's claimed invention are illustrated schematically in the accompanying drawings, which are intended for illustrative purposes only.

FIG. 1A illustrates a first support member mounted to one end of a second support member; FIG. 1B illustrates a second support member; and FIG. 1C illustrates a third support member mounted to one end of another support member.

DETAILED DESCRIPTION OF THE INVENTION

Figure 1A:
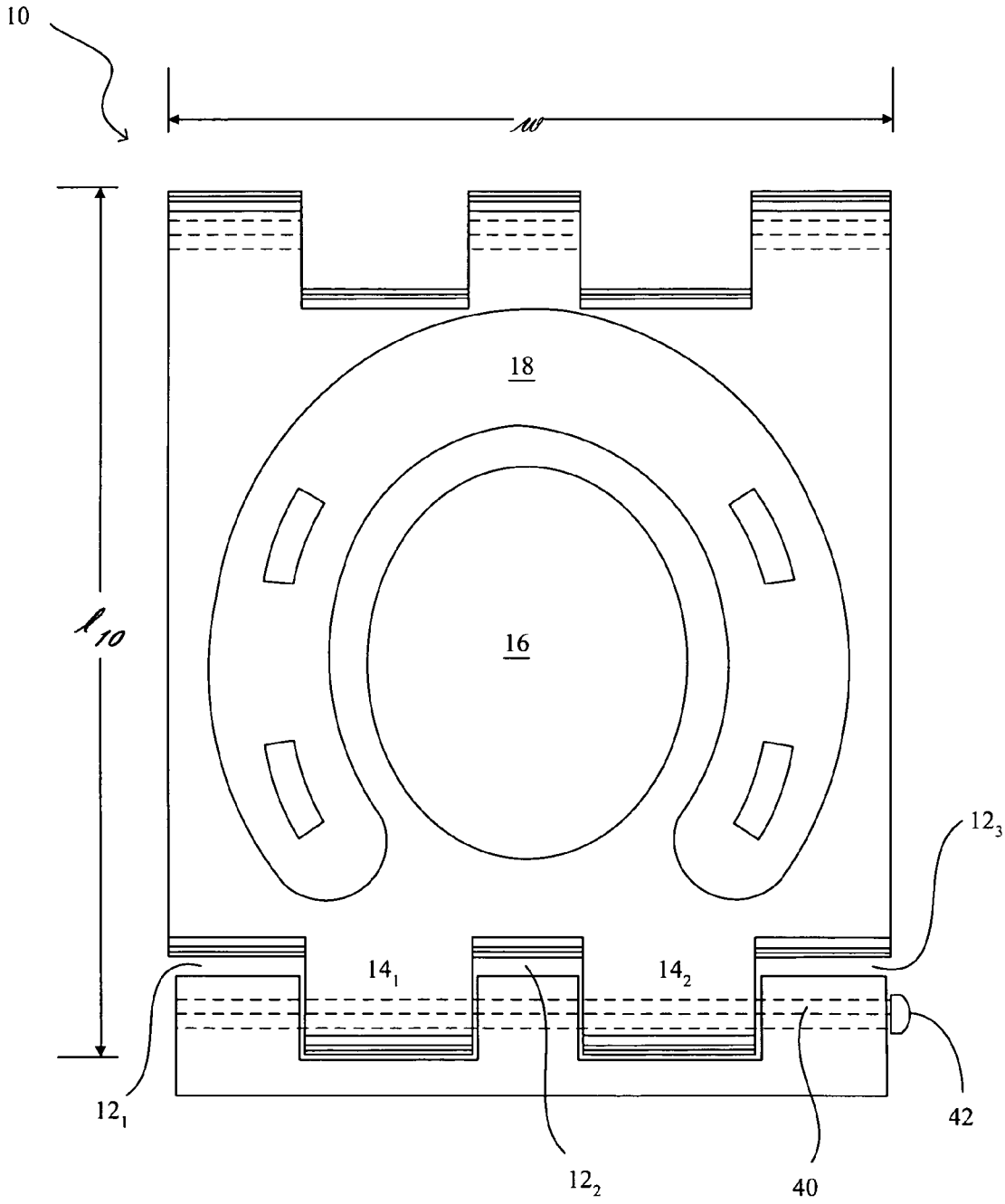
FIGS. 1A-1C illustrate top plan views of the component structures that, in combination, provide the support structure of applicant's invention.
Figure 1B:
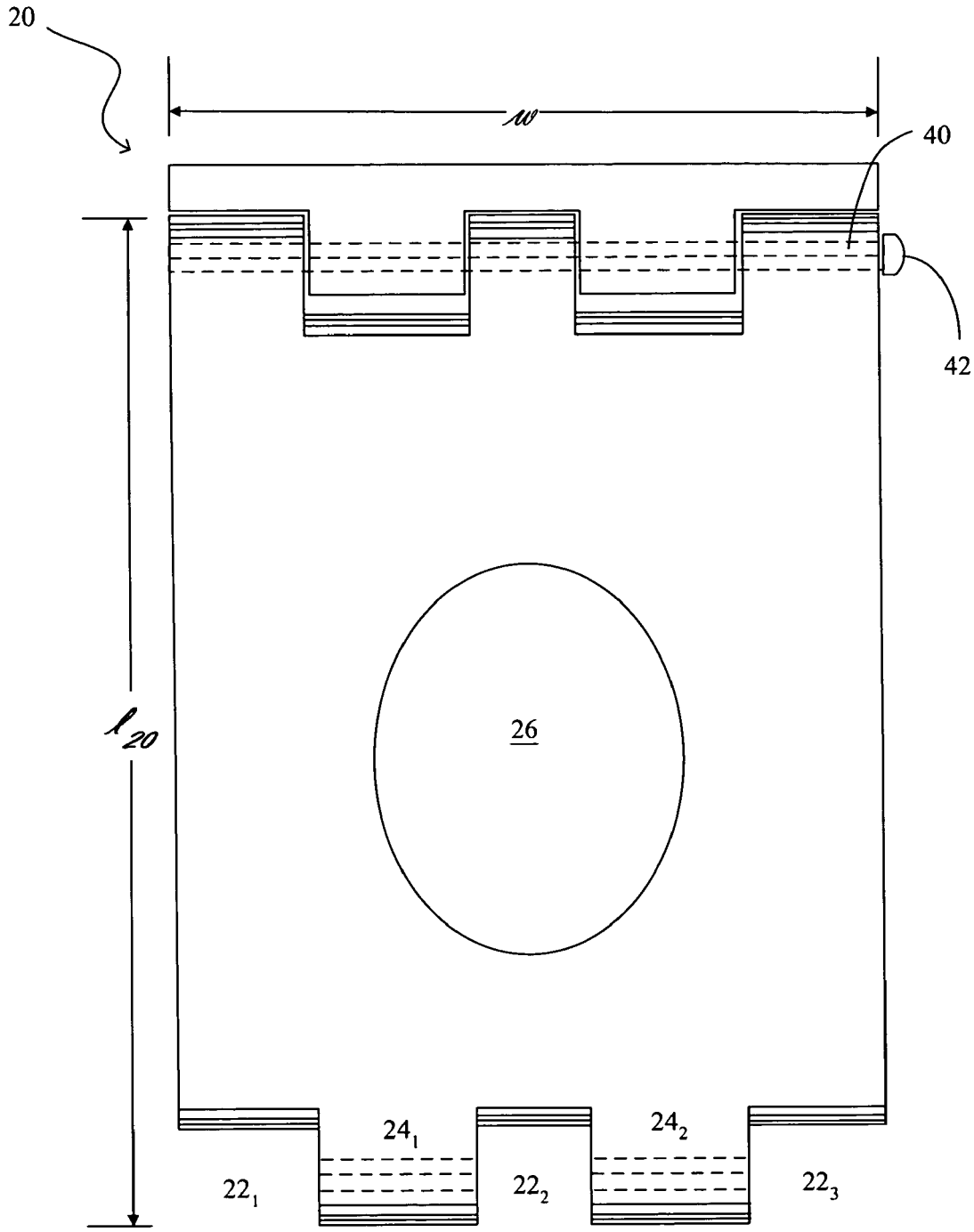
Figure 1C:
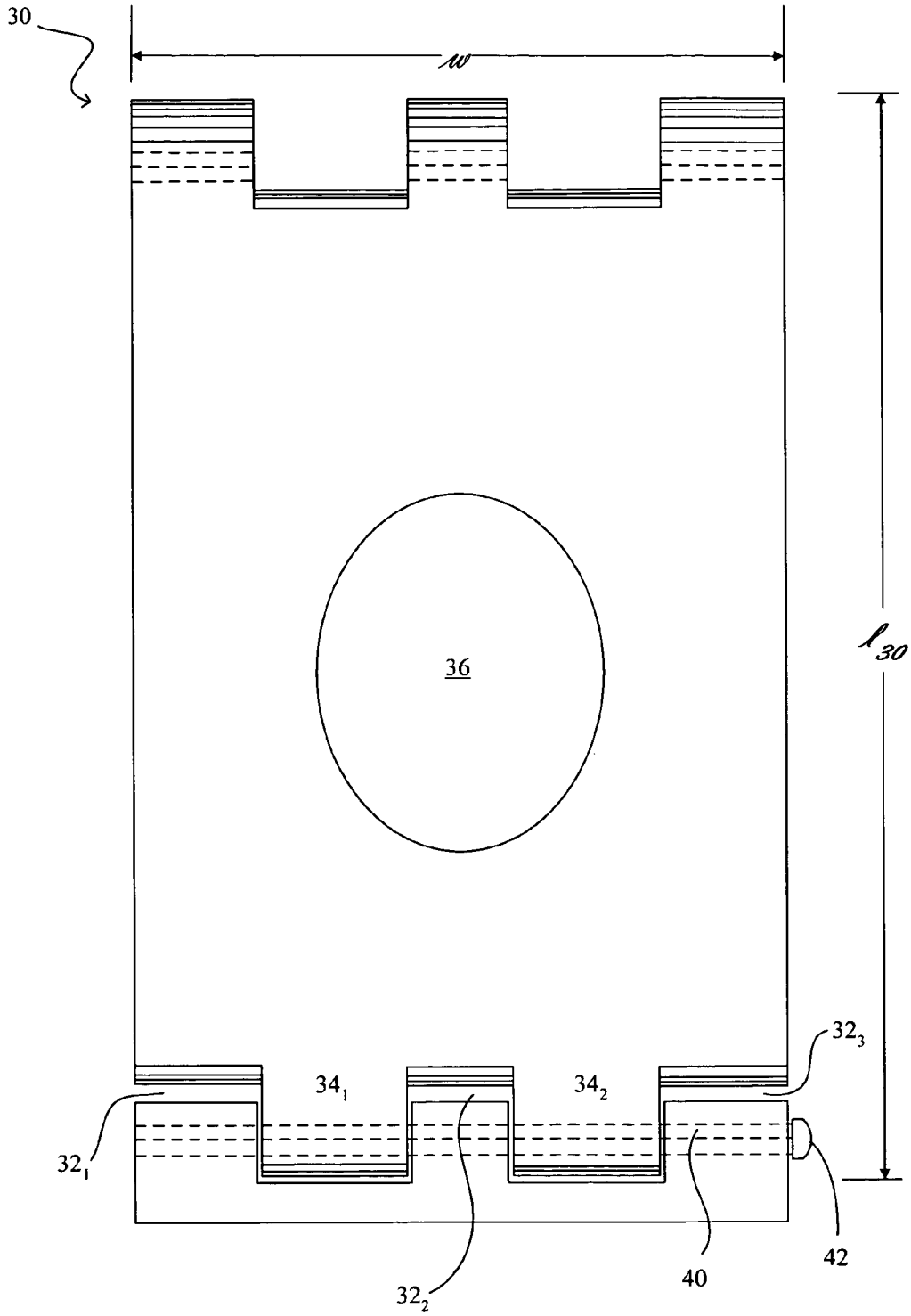

FIGS. 1A-1C illustrate three support members 10, 20 and 30 mountable to one another to provide a body treatment support structure of the present invention. Each of the support members 10, 20 and 30 is generally rigid and has a generally rectangular configuration. One or more of the support members may have a non-skid surface or a cushioned surface on one of its facing surfaces. Support members 10, 20 and 30 may be fixed in their dimensions or may have at least one adjustable dimension such that the length, for example, of one or more support members may be varied by a user to adapt the structure for use in a particular environment or application. In one embodiment, for example, a support member may be provided as a telescoping member lockable in one or more different positions to provide a support member adjustable to various lengths.

In the embodiment illustrated, the width w of each of the support members (10, 20, 30) is substantially similar. The length $l_{10}$ of support member 10 is less than the length $l_{20}$ of support member 20, which is less than the length $l_{30}$ of support member 30. In one embodiment, the length of each support member is different and is at least about 10% greater than the length of the next shortest support member. According to another embodiment, the length of each support member is at least about 15% greater than the length of the next shortest support member. While three support members are illustrated, additional support members may be provided. In particular, it may be desirable, for certain embodiments, to provide additional support members having different lengths to permit assembly of support structures having different dimensions.

Each of the support members 10, 20 and 30 is mountable to at least one of the other support members. In the embodiment illustrated, at least one end of each support member has a toothed configuration of alternating projecting tabs and recesses that mates with corresponding tabs and recesses provided on at least one of the other support members. In the embodiments illustrated, one end of each support member is provided with three recesses ($\mathbf{12}_1$, $\mathbf{12}_2$, $\mathbf{12}_3$), ($\mathbf{22}_1$, $\mathbf{22}_2$, $\mathbf{22}_3$), ($\mathbf{32}_1$, $\mathbf{32}_2$, $\mathbf{32}_3$), and two projecting tabs ($\mathbf{14}_1$, $\mathbf{14}_2$), ($\mathbf{24}_1$, $\mathbf{24}_2$), ($\mathbf{34}_1$, $\mathbf{34}_2$). The opposite end of each support member is provided with a mating, inverse arrangement of recesses and projecting tabs such that one end of each support member may be matched with one end of any other support member by fitting the tabs into recesses and vice versa.

Support members are mountable to one another in a rotatable or stationary condition. In one embodiment, projecting tabs are provided with a continuous bore extending along the width of each tab sized to receive a pin 40. When mating ends of two support members are engaged with one another such that the projecting tabs on one support member are received in matching recesses of another support member (and vice versa), bores in the aligned projecting tabs of mating support members are aligned and pin 40 is insertable through the aligned bores to mount two support members to one another. Pin 40 may be provided with an enlarged knob 42 to stop insertion of the pin through support member bores. Pin 40 may optionally be provided with a retention mechanism for retaining the pin in place when mounted through support member bores.

Additional support members may be mounted to exposed ends of support members in the same fashion using pins or similar mechanisms. In this fashion, three or more support members may be mounted to one another and various support members having different dimensions or properties may be interchanged or substituted at will. Any two adjoining support members are fixable in a stationary condition at one or more desired angle(s), as described below, to provide a treatment structure having different configurations. In this embodiment, the support members may be disassembled and stacked for storage and transporting and assembled quickly and conveniently at a desired treatment site.

While a projecting tab and recess arrangement using a pin for rotatably mounting support members to one another has been described and illustrated, it will be appreciated that many other types of mounting mechanisms may be used. In one embodiment, for example, support members may be permanently hinged with respect to one another. In another embodiment, individual support members may be mountable to one another in predetermined positions to provide assembly of the component support members in predetermined configurations. In this embodiment, the support members may not be rotatable with respect to one another.

One or more of the support members may be provided with a generally circular or oval cavity or cut-out (16, 26, 36) in a generally central location. The peripheral edges of the support member adjacent the cut-out support a subject's head as the head rests on the support member while the cavity or cut-out receives the subject's face and allows the subject to breath comfortably. An annular or horseshoe-shaped cushion 18 may be provided in proximity to the peripheral edges of the support member adjacent the cutout to comfortably support the subject's head. Additional cushions may be provided in connection with other support members for enhanced comfort. One or more cushion(s) may be provided as an integral part of one or more support member(s) or, in a preferred embodiment, may be provided as separate components mountable to one or more support member(s).

Support members 10, 20 and 30 are thus mountable to one another and may be rotatable with respect to one another in a mounted condition. One or more locking mechanisms may be provided to lock the position of adjoining support members in the desired relationship. In one embodiment, the locking mechanism comprises a pin insertable in mating recesses at the junction of two support members to stop pivoting movement of the support members at a predetermined angle. Locking pins and locking mechanisms may be provided for fixing two adjacent support members in a stationary condition at different angular positions. FIGS. 2 and 3 illustrate alternative arrangements support members may form depending on the angular relationship of adjoining support members. Additional configurations employing three or more support members are contemplated.

Figure 2A:
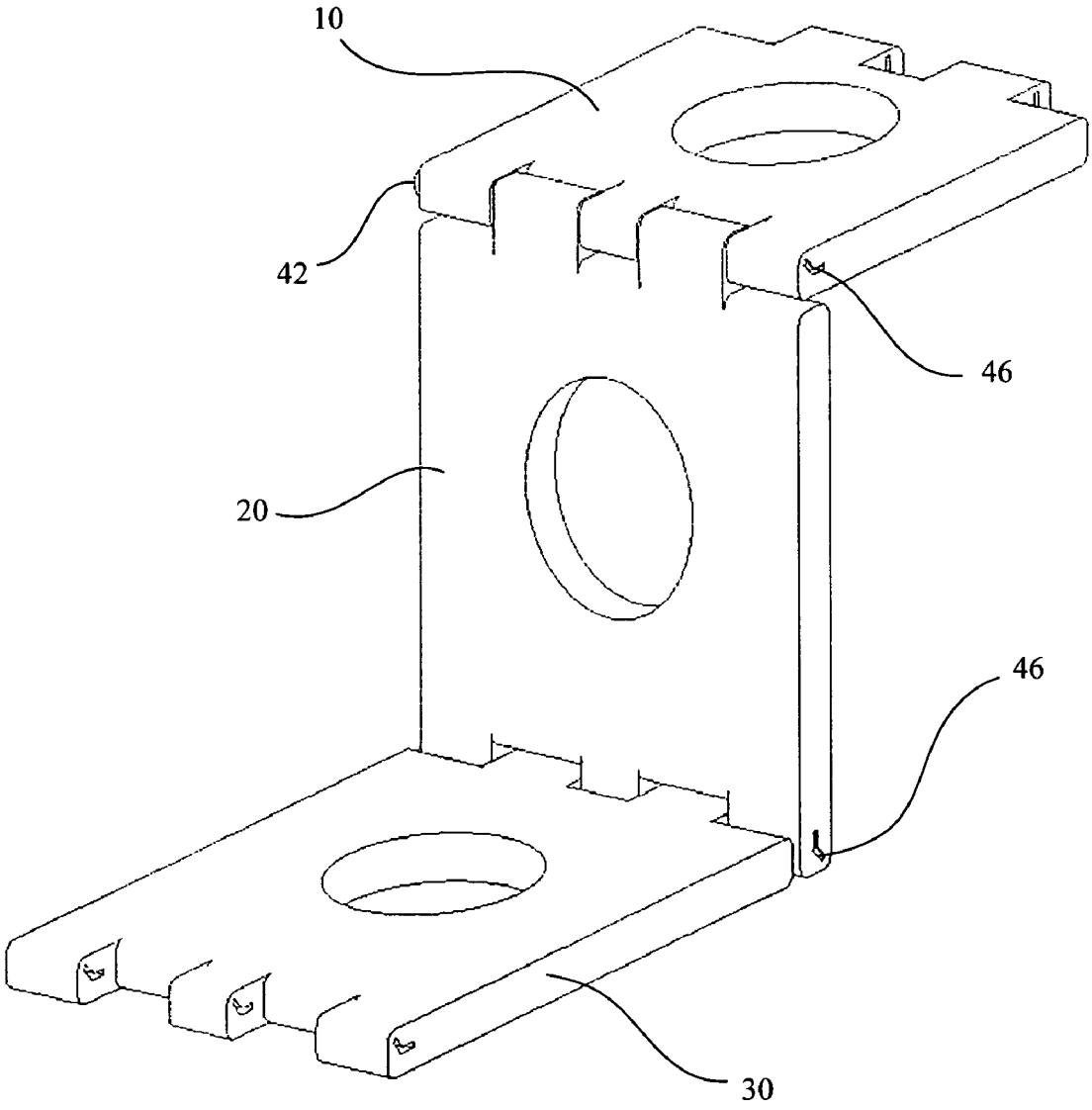
FIG. 2A illustrates a side perspective view of component support structures mounted to one another in one configuration to provide a structure that may be used with a bed, for example, to provide a face support extending from the bed.
Figure 2B:
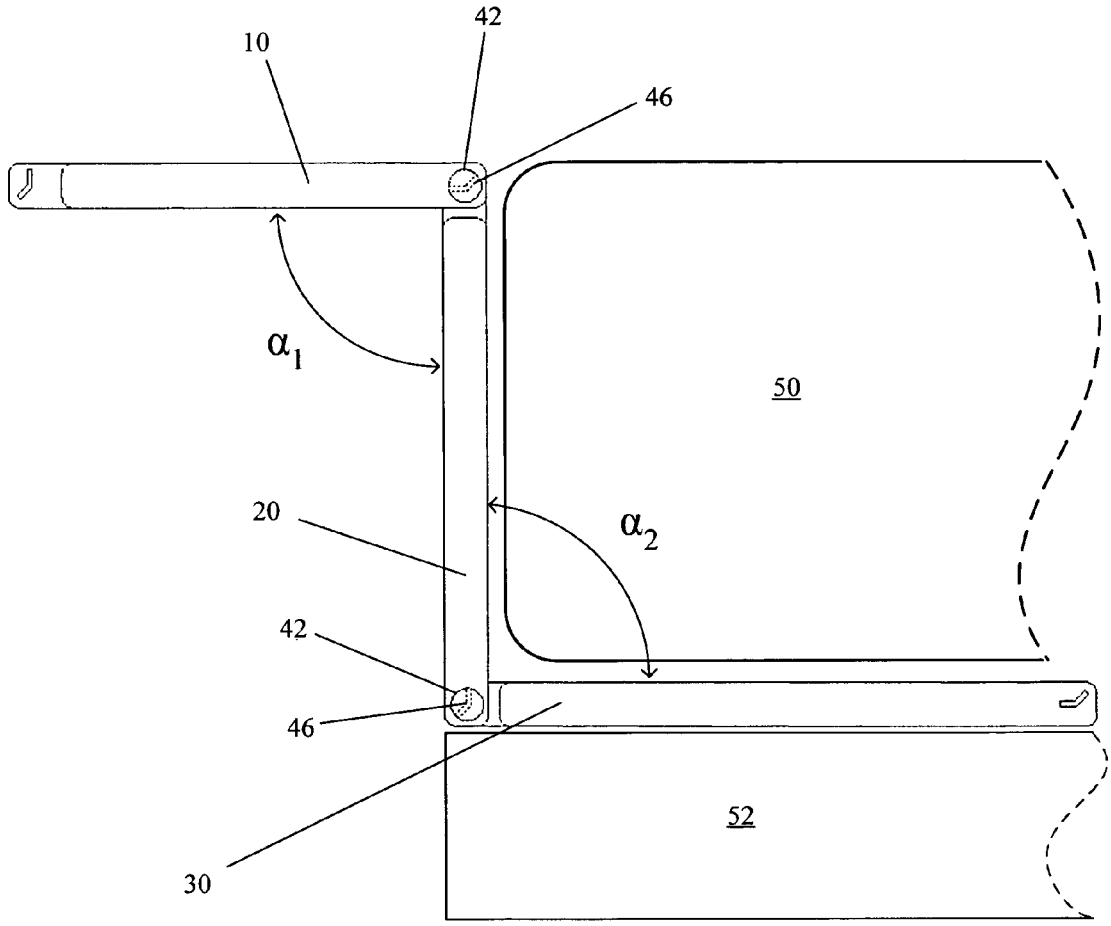
FIG. 2B illustrates a side view of the embodiment of FIG. 2A mounted between a mattress and a box spring.

FIGS. 2A and 2B illustrate an adjustable treatment support structure of the present invention assembled in one configuration suitable for use with a subject that is prone on a bed or other support structure. As shown in FIG. 2B, the support structure may be positioned between a mattress 50 and a box spring or bed frame structure 52 to provide support for a subject in a prone position. In the embodiment illustrated in FIGS. 2A and 2B, first support member 10 is mounted to second support member 20, which is mounted to third support member 30. Locking pins 46 are inserted to fix first support member 10 and second support member 20 at a substantially right angle $\alpha_1$ and to fix second support member 20 and third support member 30 at a substantially right angle $\alpha_2$.

Third support member 30 may be positioned between a mattress and box springs, as illustrated in FIG. 2B, or between a mattress or spring and a bed frame structure to firmly anchor the treatment support structure on the bed. The length of second support member 20 preferably corresponds generally to the thickness of the mattress or mattress and spring combination such that first support member 10 forms an extension of the mattress surface. Support members having different lengths may be provided in kits of the present invention to permit the user to customize the fit of the support structure to the user's mattress arrangement and to allow use of the body treatment support structure in a variety of settings. When the adjustable support structure is mounted on a bed, as illustrated in FIG. 2B, the subject may lie prone on the bed with his/her head extending past the edge of the mattress and resting on first support member 10.

Figure 3A:
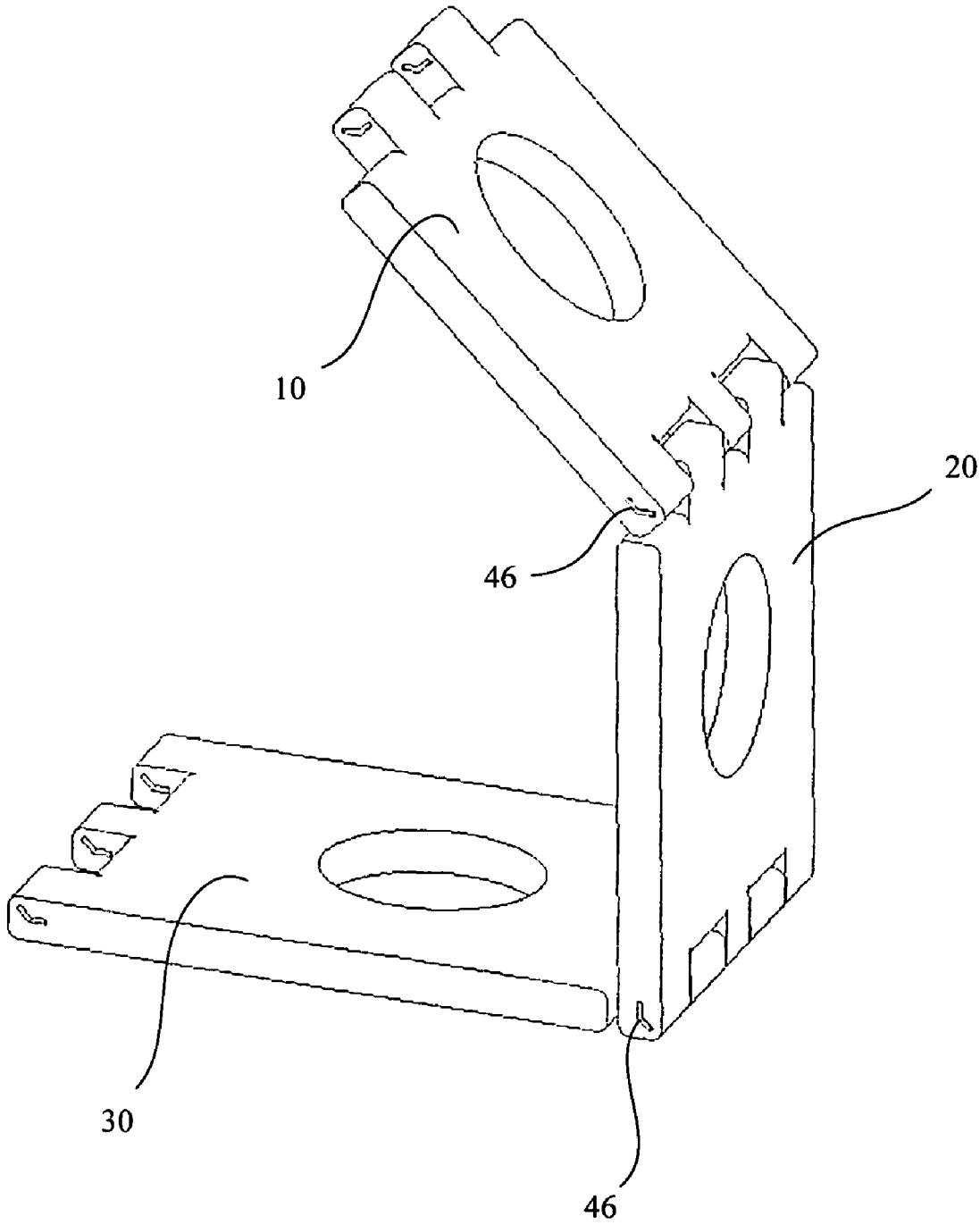
FIG. 3A illustrates a side perspective view of component support structures of the present invention mounted to one another in an alternative configuration to provide a structure for supporting a subject's head at an angle when the subject is in a standing or seated position.
Figure 3B:
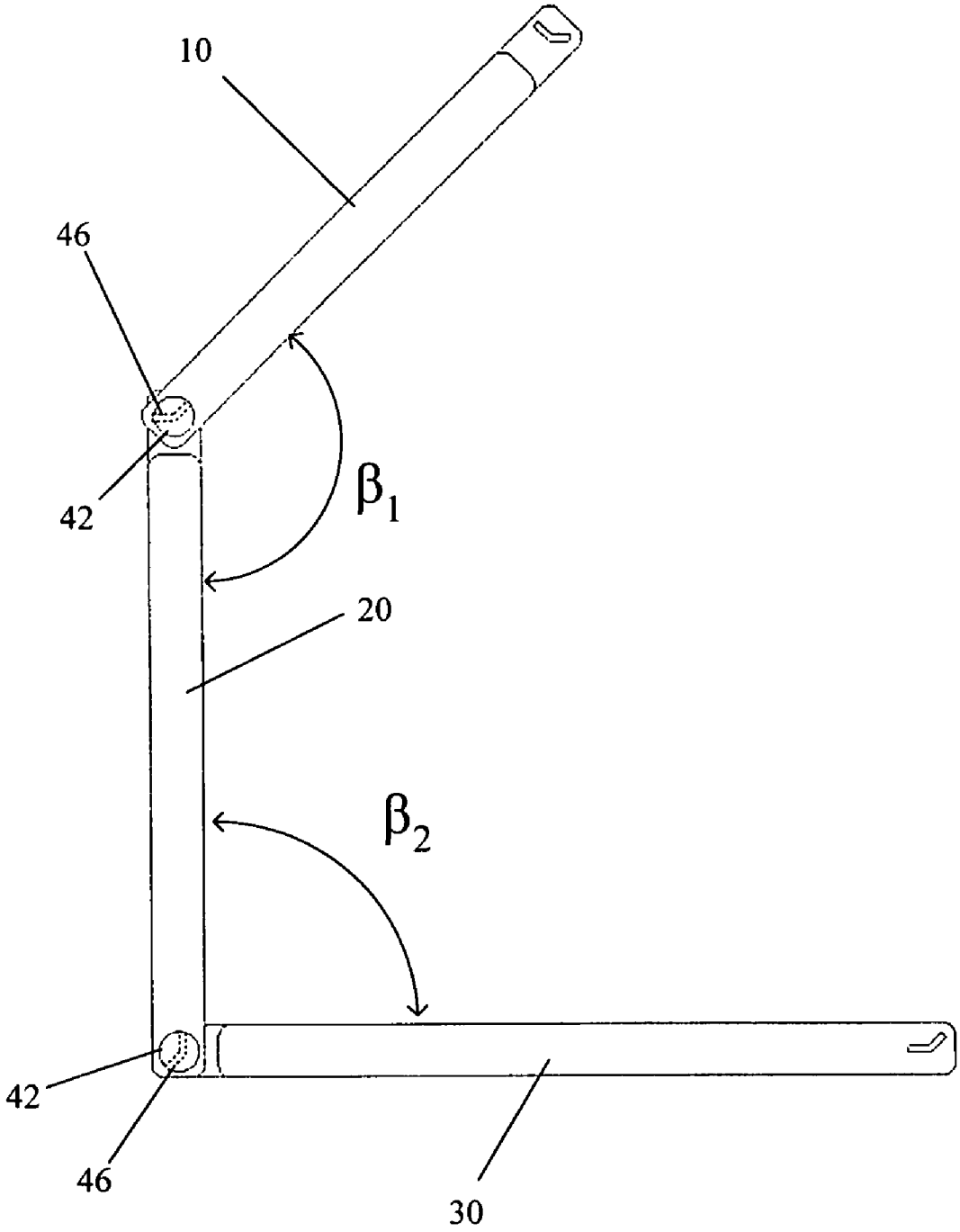
FIG. 3B illustrates a side view of the embodiment of FIG. 3A.

A second position of the adjustable support structure of the present invention is illustrated in FIGS. 3A and 3B. In this configuration, first support member 10 is mounted to second support member 20 which, in turn, is mounted to third support member 30. Locking pins 46 are inserted to fix first support member 10 and second support member 20 to one another at an angle $\beta_1$ of from about 90° to 180° and to fix second support member 20 and third support member 30 to one another at an angle $\beta_2$. In this configuration, the adjustable support structure of the present invention may be used in connection with a table and chair to provide a body treatment structure for use when a subject is seated in a chair.

In the assembled embodiment illustrated in FIGS. 3A and 3B, second support member 20 and third support member 30 are preferably locked with respect to one another at a fixed angle $\beta_2$. In one embodiment, angle $\beta_2$ is a substantially right angle. In an alternative embodiment, one or more angle(s) $\beta_2$ may be chosen at an angle of 90° or less. First support member 10 and second support member 20 may be mountable to one another such that the support members are rotatable with respect to one another between an angle $\beta_1$ of from about 90° to about 180° and lockable at selected angles within that range to provide variable positioning of support member 10 at one or more angles $\beta_1$. In a preferred embodiment, the position of support member 10 is lockable at an angle $\beta_1$ of from about 120° to about 150° with respect to support member 20, and most preferably at an angle $\beta_1$ of about 135°.

In the configuration illustrated in FIGS. 3A and 3B, support member 30 of the adjustable treatment support structure is set on a table or similar structure. Optional clamps may be provided to mount the support structure to a table. Upstanding support member 20 is positioned to extend from a location near an edge of the table and a subject is seated in a chair or on a stool facing the support structure. In this position, the subject rests his/her head on support member 10 to expose the back and shoulder areas for treatment.

Locking pins 46 may have a generally cylindrical cross-sectional configuration matching generally cylindrical bores provided in the support members. In another embodiment, locking pins 46 have a non-cylindrical cross-sectional configuration, as shown in FIGS. 2 and 3, in which two angled portions are arranged at a generally obtuse angle with respect to one another. Matching angled slots are provided in the support members such that when two support members are arranged and interlocked in a first orientation, the bores are aligned in a first alignment and the angled pin may be inserted to retain the support members in the first orientation. When two support members are arranged and interlocked in a second orientation, the bores are aligned in a second alignment and the angled pin may be inserted to retain the support members in the second orientation. Alternative locking structures are well known in the art and may be incorporated, additionally or alternatively, in the support structures of the present invention.

The adjustable treatment support structure of the present invention may be provided as a kit comprising at least three adjustable support members, as described above, and may also comprise additional, mating support members having different dimensions. The kit of the present invention may also comprise a bag for storing and transporting the support members, instructional materials for assembling the support members in various configurations and for administering various types of treatment using the support structure. The kit may further comprise music, lotions, oils, candles and other accessories.

While specific embodiments of components, support structures and kits of the present invention have been described in detail, it will be understood that various changes may be made without departing from the spirit and scope of the present invention.

I claim:

1. An adjustable body treatment support structure comprising: a first substantially rigid support member mounted to and rotatable with respect to a second substantially rigid support member, the second substantially rigid support member being mounted to and rotatable with respect to a third substantially rigid support member, whereby the first, second and third support members each have an angled slot for receiving a locking pin having two angled portions arranged at a generally obtuse angle with respect to one another and are adjustable with respect to one another by inserting the angled portions of a locking pin in the angled slots to interlock support members, whereby the first, second and third support members may be arranged in at least a first angular position in which the support members are at generally right angles to one another to provide the first support member extending from the second support member in a first direction and the third support member extending from the second member in a second direction opposite the first direction, and a second angular position in which the first and second support members are arranged at generally right angles to one another and the third support member extends from the second support member at an internal angle of from about 90° to about 160°.

2. An adjustable body treatment support structure of claim 1, wherein the first, second and third support members are detachably mounted to one another.

3. An adjustable body treatment support structure of claim 1, wherein the second and third support members are fixable in a stationary condition with respect to one another at an internal angle of about 135°.

4. An adjustable body treatment support structure of claim 1, wherein the first, second and third support members are mountable to one another interchangeably.

5. A body treatment support structure of claim 1, additionally comprising one or more accessories selected from the group consisting of: instructional materials for assembling the support structures; one or more cushions mountable on a support structure; instructional materials relating to massage or relaxation techniques; a bag for storing and transporting the kit components; oil; emollients; candles; and music.

6. A kit for assembling an adjustable body treatment support structure comprising: a first substantially rigid support member mountable to a second substantially rigid support member, the second substantially rigid support member being mountable to a third substantially rigid support member, whereby the first, second and third support members each have angled slots, and the kit additionally comprises at least two locking pins, each of the locking pins having two angled portions arranged at an obtuse angle with respect to one another, the angled portions of the locking pins matching the angled slots in each of the support members; whereby the support members are interlockable with respect to one another in at least a first angular position by aligning the angled slots in a first orientation and inserting a locking pin and in a second angular position by aligning the angled slots in a second orientation and inserting a locking pin.

7. A kit of claim 6, wherein the first, second and third support members are detachably mountable to one another.

8. A kit of claim 6, wherein the support members are mountable to one another interchangeably.

9. A kit of claim 6, wherein at least one of the support members comprises a recess or cut-out for supporting a subject's head and providing air circulation to a subject's face.

10. A kit of claim 9, additionally comprising a cushioned head support detachably mountable to at least one of the support members.

11. A kit of claim 6, wherein the first and second support members are mountable to one another and fixable in a stationary condition with respect to one another at a substantially right angle and the second and third support members are mountable to one another and fixable in a stationary condition with respect to one another at a substantially right angle.

12. A kit of claim 6, wherein the first and second support members are mountable to one another and fixable in a stationary condition with respect to one another at a substantially right angle and the second and third support members are mountable to one another and fixable in a stationary condition with respect to one another at an internal angle of from about 90° to about 160°.

13. A kit of claim 6, wherein the second and third support members are mountable to one another and fixable in a stationary condition with respect to one another at an internal angle of about 135°.

14. A kit of claim 6, wherein the locking pins that penetrate angled slots provided in the support members have enlarged knobs that are not capable of penetrating the angled slots.

15. A kit of claim 6, additionally comprising one or more accessories selected from the group consisting of: instructional materials for assembling the support structures; one or more cushions mountable on a support structure; instructional materials relating to massage or relaxation techniques; a bag for storing and transporting the kit components; oil; emollients; candles; and music.

16. A body treatment support structure comprising: a first substantially rigid support member having a first length dimension, a second substantially rigid support member having a second length dimension and a third rigid support member having a third length dimension, wherein the first, second and third length dimensions are different, wherein the first, second and third support members each have angled slots that mate with locking pins having two angled portions arranged at an obtuse angle with respect to one another, and the first, second and third support members are mountable to one another interchangeably to position the support structure in at least two different arrangements by interlocking respective support members in different orientations using the locking pins, whereby the first, second and third support members may be arranged in at least a first angular position in which the first, second and third support members are mountable at generally right angles to one another to provide a first support member extending from the second support member in a first direction and a third support member extending from the second member in a second direction opposite the first direction and a second angular position in which first and second support members are arranged at generally right angles to one another and a third support member extends from the second support member at an internal angle of from about 90° to about 160°.

17. A body treatment support structure of claim 16, wherein at least one of the support members comprises a recess or cut-out for supporting a subject's head and providing air circulation to a subject's face.

18. A body treatment support structure of claim 16, additionally comprising a cushioned head support detachably mountable to at least one of the support members.

19. A body treatment support structure of claim 16, additionally comprising one or more accessories selected from the group consisting of: instructional materials for assembling the support structures; one or more cushions mountable on a support structure; instructional materials relating to massage or relaxation techniques; a bag for storing and transporting the kit components; oil; emollients; candles; and music.

* * * * *